US007723625B1

(12) United States Patent
Vergari et al.

(10) Patent No.: US 7,723,625 B1
(45) Date of Patent: May 25, 2010

(54) ULTRA LOW PRESSURE SWITCH SYSTEM

(75) Inventors: Mark S. Vergari, Oneonta, NY (US); Felix M. Castro, Dallas, GA (US)

(73) Assignee: Mold-a-Matic, Oneonta, NY (US)

( * ) Notice: Subject to any disclaimer, the term of this patent is extended or adjusted under 35 U.S.C. 154(b) by 632 days.

(21) Appl. No.: 11/555,312

(22) Filed: Nov. 1, 2006

(51) Int. Cl.
*H01H 35/34* (2006.01)

(52) U.S. Cl. ..... 200/83 R; 73/715

(58) Field of Classification Search ..... 200/83 R, 200/83 F, 83 A, 83 J, 83 N, 83 P, 83 V, 81 R; 73/715
See application file for complete search history.

(56) References Cited

U.S. PATENT DOCUMENTS 3,860,772 A * 1/1975 Byrd ..... 200/83 N
4,121,074 A * 10/1978 Orcutt et al. ..... 200/83 P
4,342,887 A * 8/1982 Sanford ..... 200/83 P
4,521,651 A * 6/1985 Matsumoto et al. ..... 200/83 R
4,581,509 A * 4/1986 Sanford et al. ..... 200/83 P
4,951,810 A * 8/1990 Everett ..... 200/83 A
2003/0200813 A1* 10/2003 Baba et al. ..... 73/715
2006/0144152 A1* 7/2006 Cabuz et al. ..... 73/715
2008/0041710 A1* 2/2008 Kranjc ..... 200/83 R

* cited by examiner

*Primary Examiner*—Renee S Luebke
*Assistant Examiner*—Sean Kayes
(74) *Attorney, Agent, or Firm*—Michael S. Neustel

(57) ABSTRACT

An ultra low pressure switch system for efficiently reducing switch deterioration. The ultra low pressure switch system generally includes a housing comprised of a first portion and a second portion, wherein the first portion and the second portion define a cavity between thereof, a first port fluidly connected to the housing, a diaphragm member positioned within the cavity, a first terminal positioned within the cavity, a second terminal positioned within the cavity and a spacer member positioned within the cavity and between the first terminal and the second terminal.

19 Claims, 11 Drawing Sheets

ULTRA LOW PRESSURE SWITCH SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to pressure switches and more specifically it relates to an ultra low pressure switch system for efficiently reducing switch deterioration.

2. Description of the Related Art

Any discussion of the prior art throughout the specification should in no way be considered as an admission that such prior art is widely known or forms part of common general knowledge in the field.

Pressure switches have been in use for years. Typically, low pressure switches utilize a deflecting beam contact and a stationary contact, wherein a desired pressure will move the deflecting beam contact downward against the stationary contact thus completing a circuit. The prior pressure switches are generally constructed using rivets through a plastic housing of the pressure switch. The rivets generally pass through the housing and connect the stationary contact and deflecting beam contact to the outside of the pressure switch.

Small variations of pressure switch walls typically found in plastic components can make it difficult to control riveting operations through the contacts. This can make it very difficult to control the placement of the stationary contact and deflecting beam contact upon the rivet. The result of the contacts not maintaining a consistent distance from one another may result in a different trip point for every low pressure switch. The switches also often have to be calibrated after they are riveted which can be very costly and time consuming.

Environments in which the pressure switches are utilized in generally are very inconsistent. Expansion and contraction of the chamber walls of the switch from temperature changes and induced stress during riveting operation of the contacts may have a significant effect over the functioning and stability of the switch trip points. Because of the general lack of efficiency and practicality in the prior art there is the need for a new and improved ultra low pressure switch system for efficiently reducing switch deterioration.

BRIEF SUMMARY OF THE INVENTION

The general purpose of the present invention is to provide an ultra low pressure switch system that has many of the advantages of the pressure switches mentioned heretofore. The invention generally relates to a pressure switch which includes a housing comprised of a first portion and a second portion, wherein the first portion and the second portion define a cavity between thereof, a first port fluidly connected to the housing, a diaphragm member positioned within the cavity, a first terminal positioned within the cavity, a second terminal positioned within the cavity and a spacer member positioned within the cavity and between the first terminal and the second terminal.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide an ultra low pressure switch system for efficiently reducing switch deterioration.

Another object is to provide an ultra low pressure switch system that is small in size.

An additional object is to provide an ultra low pressure switch system that is not affected by temperature changes.

A further object is to provide an ultra low pressure switch system that requires no calibration after the switch has been manufactured.

Another object is to provide an ultra low pressure switch system that is low in cost.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
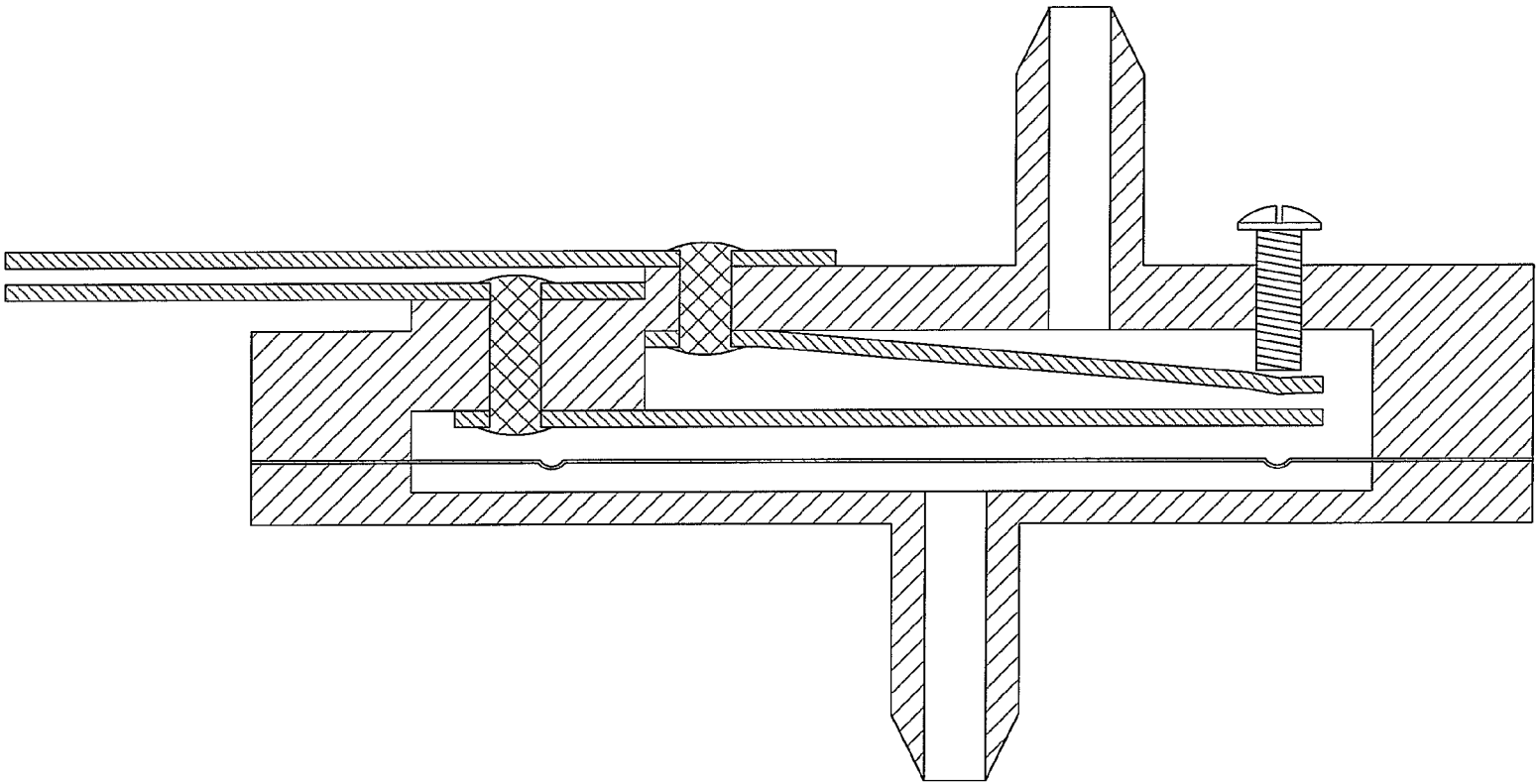
FIG. 1 (Prior Art)
FIG. 1 is a side cutaway view of a prior art pressure switch.

Turning now descriptively to the drawings, in which similar reference characters denote similar elements throughout the several views, FIGS. 2 through 11 illustrate an ultra low pressure switch system 10, which comprises a housing 20, 60 comprised of a first portion 20 and a second portion 60, wherein the first portion 20 and the second portion 60 define a cavity 23 between thereof, a first port 21 fluidly connected to the housing 20, 60, a diaphragm member 40 positioned within the cavity 23, a first terminal 30 positioned within the cavity 23, a second terminal 50 positioned within the cavity 23 and a spacer member 40 positioned within the cavity 23 and between the first terminal 30 and the second terminal 50.

B. First Housing Portion

Figure 2:
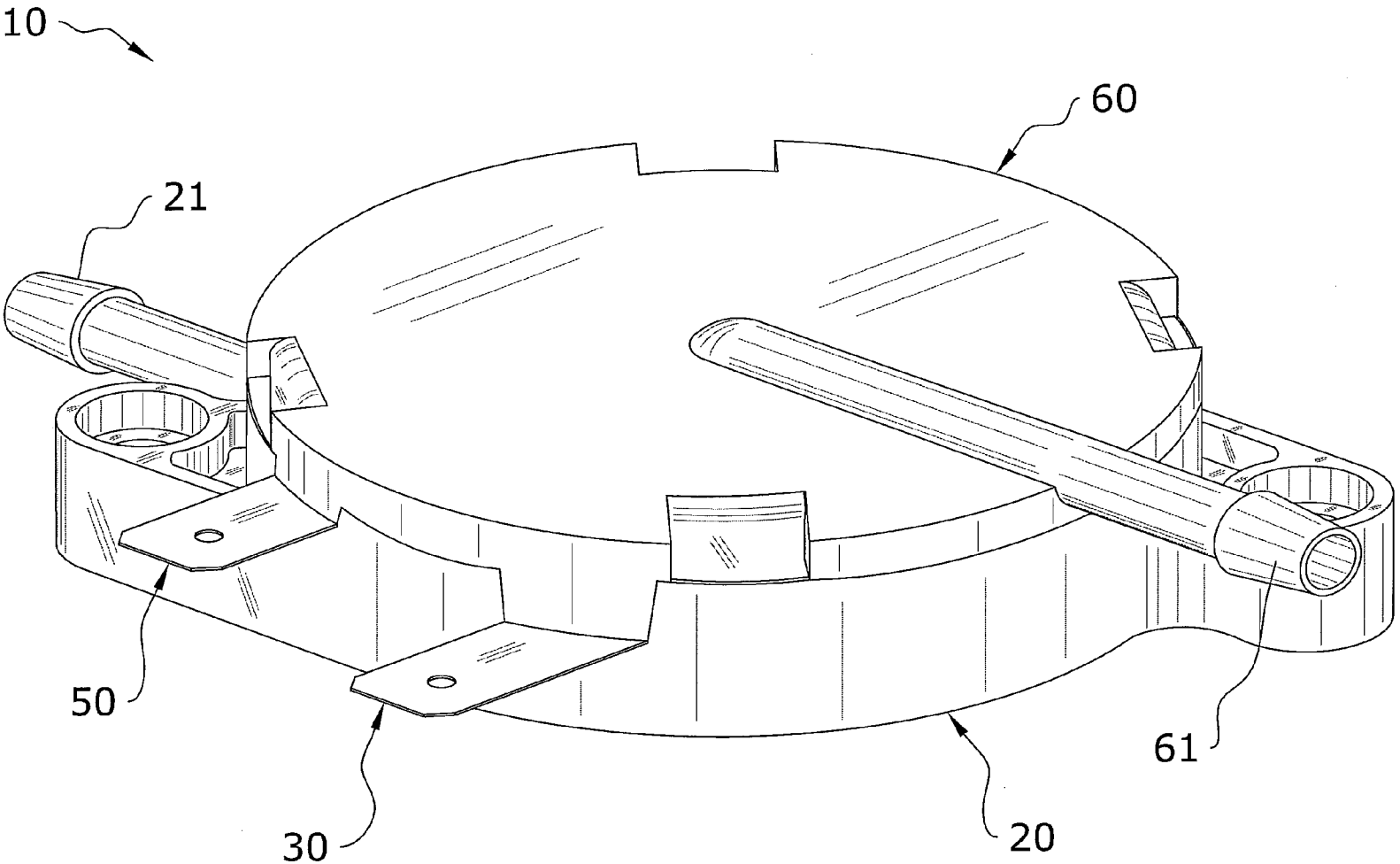
FIG. 2 is an upper perspective view of the present invention.
Figure 3:
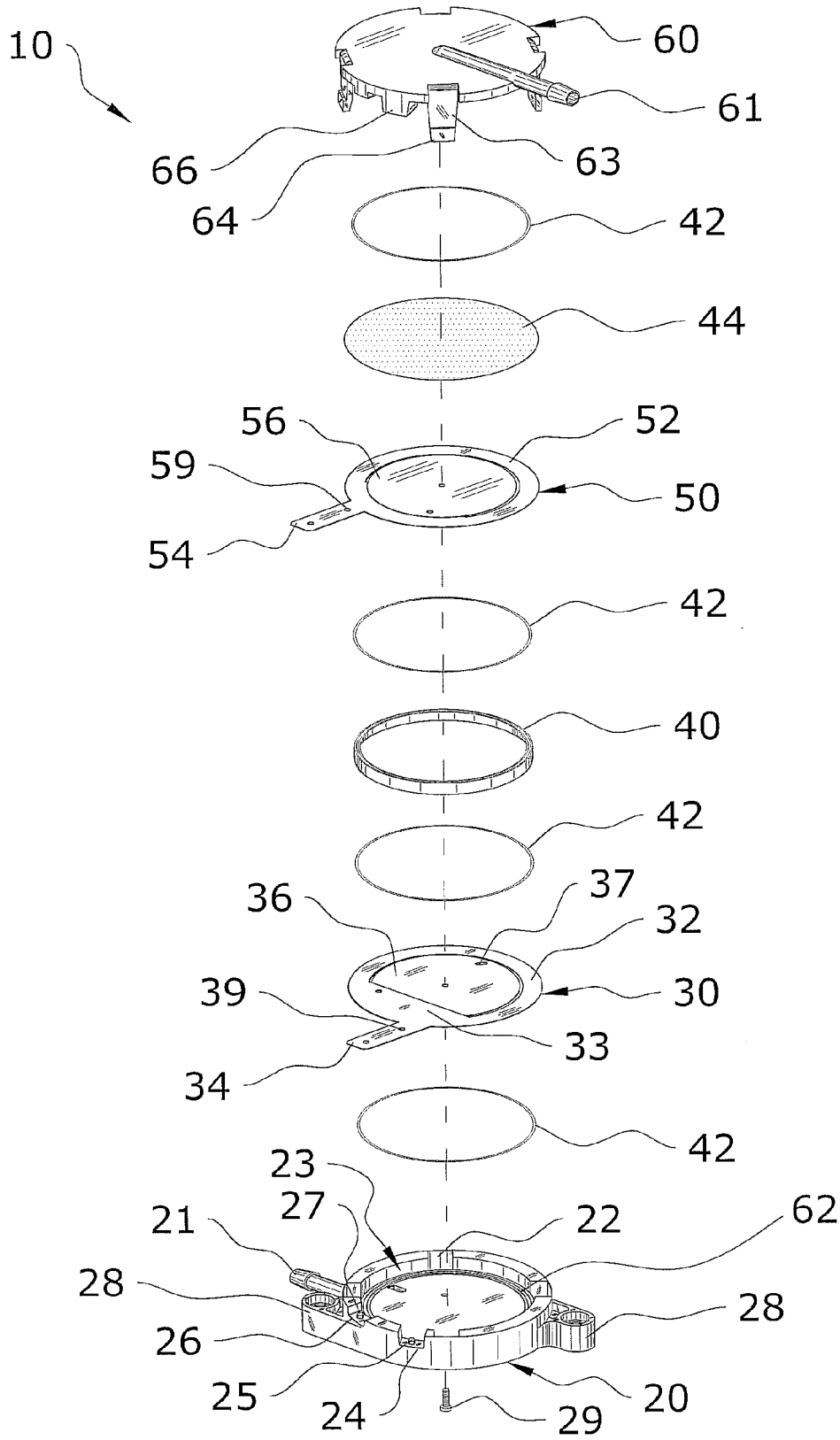
FIG. 3 is an exploded upper perspective view of the present invention.

The first housing portion 20 is preferably comprised of a substantially circular configuration as illustrated in FIGS. 2 and 3; however it is appreciated that the first housing portion 20 may be comprised of various configurations rather than the preferred embodiment, such as but not limited to elliptical or rectangular. The first housing portion 20 is preferably comprised of a material to withstand variant temperatures and pressures. The first housing portion 20 is also preferably able to expand and contract accordingly with variant environment conditions. The material of the first housing portion 20 is further preferably comprised of plastic; however other suitable materials may be utilized with the first housing portion 20 rather than the preferred material.

The first housing portion 20 includes a first port 21, wherein the first port 21 preferably receives a first pressure. The first port 21 is preferably comprised of a tubular configuration. The first port 21 also preferably extends horizontally outward from the first housing portion 20 as illustrated in FIGS. 2 through 5. The first port 21 is also preferably fluidly connected to an inner portion of the first port 21. The first pressure of the first port 21 is preferably comprised of a vacuum pressure.

The first housing portion 20 also includes at least one mounting member 28 as shown in FIGS. 2 through 5. The mounting member 28 preferably extends horizontally outward from the first housing portion 20. There preferably exists a mounting member 28 on each opposing side of the first housing portion 20. The mounting members 28 also preferably each receive a screw or other fastener to fasten the ultra low pressure switch system 10 to an object.

Figure 5:
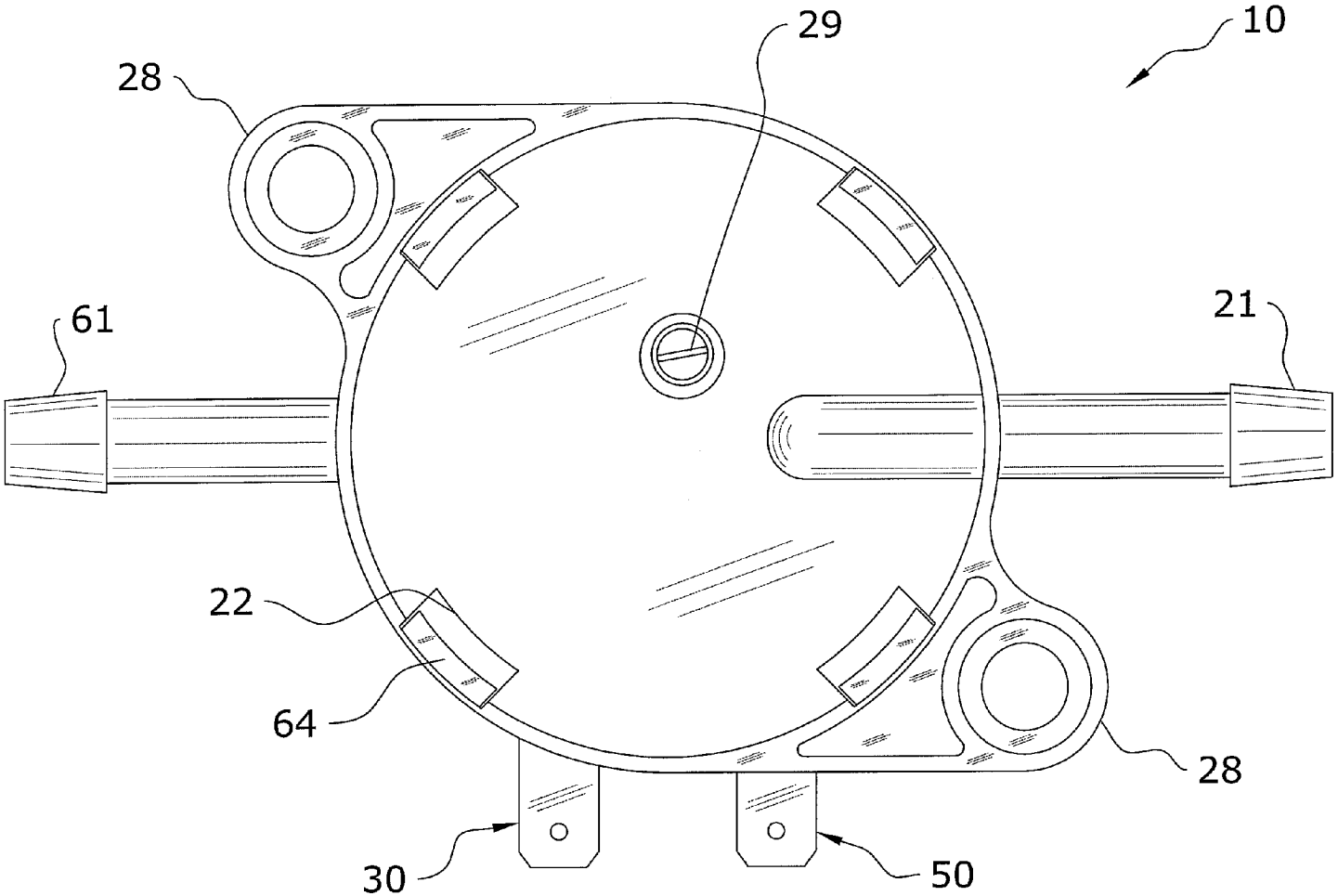
FIG. 5 is a bottom view of the present invention.

The first housing portion 20 also preferably includes a plurality of slots 22. The plurality of slots 22 preferably vertically extends through the first housing portion 20. The plurality of slots 22 are also preferably radially positioned substantially near an outer edge of the first housing portion 20 as shown in FIG. 5.

Figure 10:
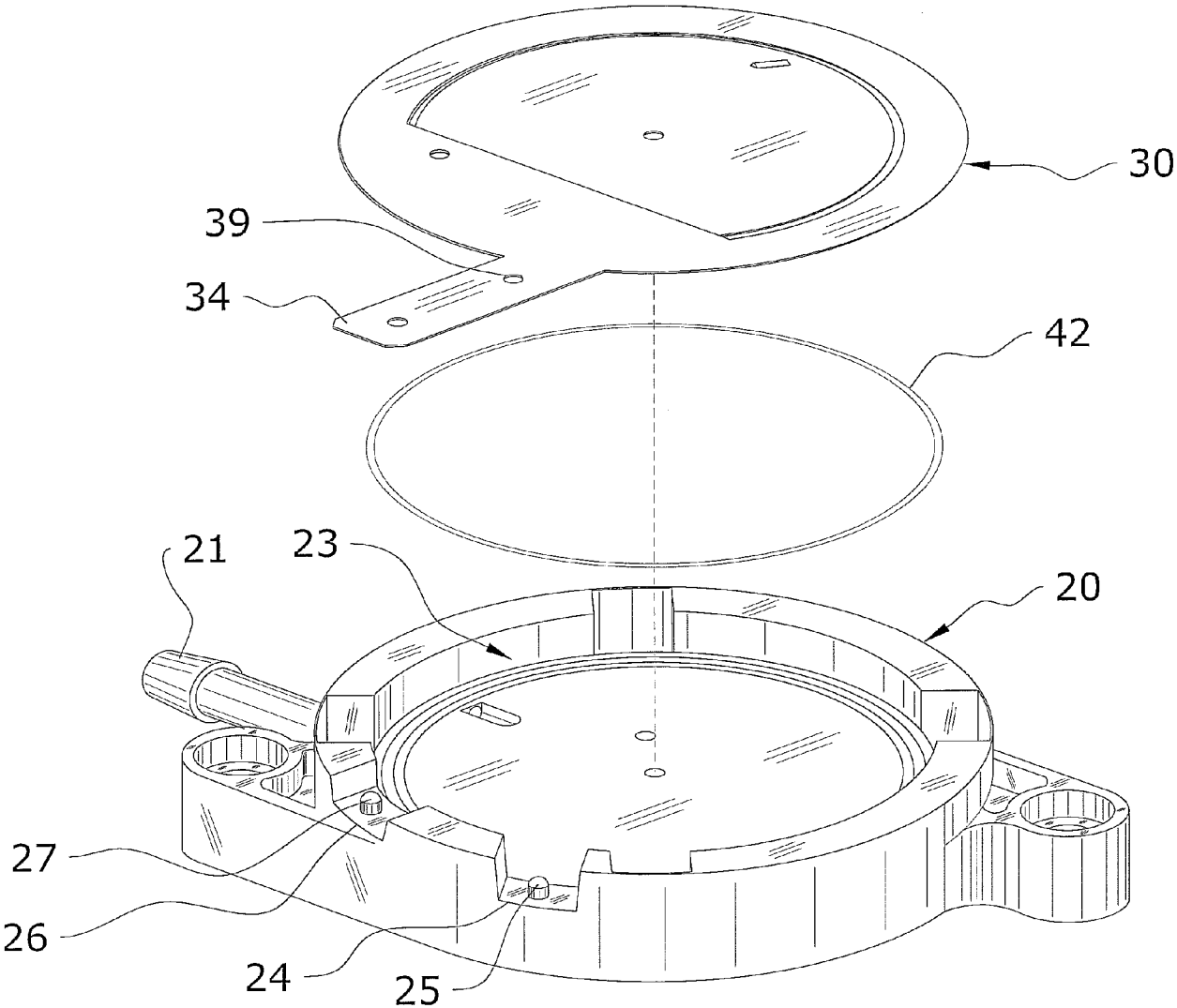
FIG. 10 is an exploded upper perspective view of the first terminal and the first portion.
Figure 11:
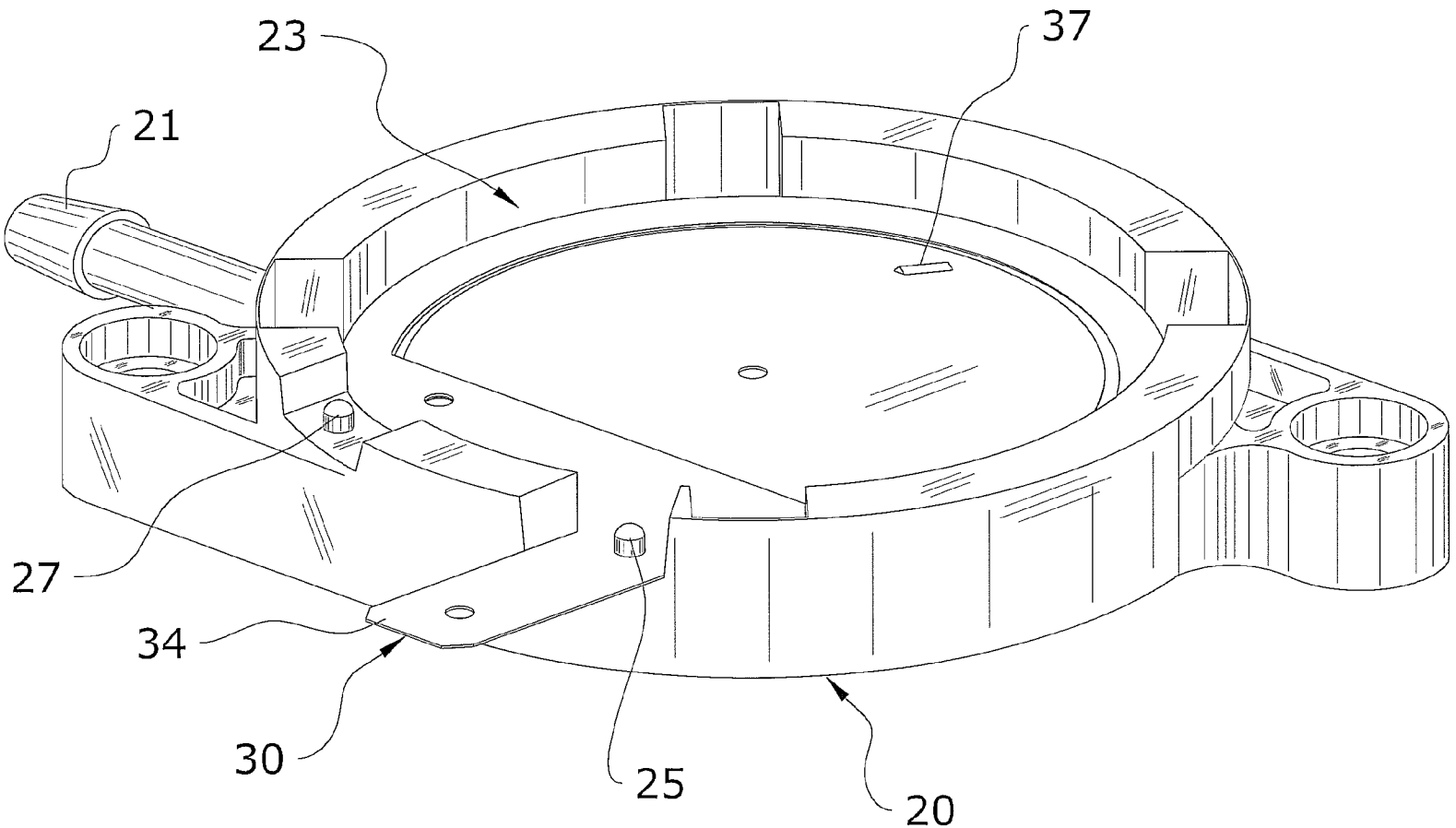
FIG. 11 is an exploded upper perspective view of the first terminal attached to the first portion.

An outer wall of the first housing portion 20 preferably includes a first recessed portion 24 and a second recessed portion 26. The first recessed portion 24 and the second recessed portion 26 preferably both form a depression along the outer wall of the first housing portion 20 as illustrated in FIGS. 3, 10 and 11. The first recessed portion 24 is preferably at a substantially lower vertical height than the second recessed portion 26. The first recessed portion 24 and the second recessed portion 26 are also both preferably comprised of a rectangular configuration; however it is appreciated that the first recessed portion 24 and the second recessed portion 26 may be comprised of various configurations rather than the preferred embodiment.

Extending vertically upward from the first recessed portion 24 is preferably a first connecting member 25. A second connecting member 27 also preferably extends vertically upward from the second recessed portion 26. The first connecting member 25 and the second connecting member 27 are both preferably comprised of a pin configuration. A first width of the first connecting member 25 and a second width of the second connecting member 27 are each preferably substantially less than a width of the outer wall of the first housing portion 20 as shown in FIGS. 3, 10 and 11.

The first housing portion 20 also includes a cavity 23. The cavity 23 of the first housing portion 20 is preferably comprised of a circular configuration. The cavity 23 of the first housing portion 20 preferably extends within the first housing portion 20 to receive the first terminal 30, the plurality of seal members 42, the spacer member 40, the diaphragm member 44 and the second terminal 50. An outer diameter of the cavity 23 is preferably substantially similar to an outer diameter of the first outer member 32 of the first terminal 30 and to an outer diameter of a second outer member 52 of the second terminal 50.

An adjustment member 29 is also preferably removably attached to a lower end of the first housing portion 20. The adjustment member 29 is preferably threadably attached to the first housing portion 20. The adjustment member 29 is preferably threadably positioned against the first terminal 30 to adjust the pressure that is desired to complete the circuit of the ultra low pressure switch system 10.

C. First Terminal

The first terminal 30 is preferably comprised of a substantially circular configuration; however it is appreciated that the first terminal 30 may be comprised of various configurations rather than the preferred embodiment, such as but not limited to elliptical or rectangular. The first terminal 30 is also preferably positionable within the cavity of the first housing portion 20 as illustrated in FIGS. 3, 10 and 11. The first terminal 30 is preferably comprised of a metal material. The first terminal 30 is further preferably comprised of an electrically conductive material.

The first terminal 30 preferably includes a first outer member 32 and a first inner member 36. The first outer member 32 is preferably comprised of a ring configuration as shown in FIGS. 3, 10 and 11. The first outer member 32 is further preferably comprised of a hard metal material so as not to bend or deform over extended use. An outer diameter of the first outer member 32 is preferably substantially similar to an outer diameter of the cavity 23.

The first outer member 32 preferably includes a first extended portion 34 and a first fulcrum portion 33. The first extended portion 34 preferably extends outwardly to form the first outer member 32. The first extended portion 34 is further preferably comprised of a rectangular configuration. The first extended portion 34 is preferably positionable within the first recessed portion 24 of the first housing portion 20.

The first outer member 32 also preferably includes a first connecting aperture 39. The first connecting aperture 39 extends through the first extended portion 34. The first connecting aperture 39 further preferably aligns with the first connecting member 25 and is positionable over the first connecting member 25 thus securing the first terminal 30 within the first housing portion 20 as illustrated in FIGS. 10 and 11.

The first outer member 32 also preferably includes a first fulcrum portion 33. The first fulcrum portion 33 preferably extends across the first outer member 32. The first fulcrum portion 33 preferably provides an overlapping region for the first inner member 36 to attach to the first outer member 32.

The first inner member 36 is preferably comprised of a circular configuration. An outer diameter of the first inner member 36 is also preferably slightly less than an inner diameter of the first outer member 32. The first inner member 36 is also preferably comprised of a brass material; however other materials may be utilized with the first inner member 36 rather than the preferred material.

The first inner member 36 is preferably spot welded to the first fulcrum portion 33 of the first outer member 32. Utilizing weld substance as a fastener between the first inner member 36 and the first outer member 32 preferably prevents the first inner member 36 from becoming loose upon the first outer member 32 over extended use. A concentric origin of the first inner member 36 is also preferably substantially similar to a concentric origin of the first outer member 32 when attaching the first inner member 36 to the first outer member 32.

The first inner member 36 also preferably includes a first contact 37. The first contact 37 preferably extends upward from an outer edge of the first inner member 36. The first inner member 36 is also preferably attached to the first outer member 32 in a manner, wherein an electrical current is able to flow between the first contact 37 and the first extended portion 34 of the first outer member 32.

D. Second Terminal

The second terminal 50 is preferably comprised of a substantially circular configuration; however it is appreciated that the first terminal 30 may be comprised of various configurations rather than the preferred embodiment, such as but not limited to elliptical or rectangular. The second terminal 50 is also preferably positionable within the cavity of the second housing portion 60 as illustrated in FIG. 3. The second terminal 50 is preferably comprised of a metal material. The second terminal 50 is further preferably comprised of an electrically conductive material. Further, the second terminal 50 and the first terminal 30 are preferably comprised of substantially similar configurations.

The second terminal 50 preferably includes a second outer member 52 and a second inner member 56. The second outer member 52 is preferably comprised of a ring configuration as shown in FIG. 3. The second outer member 52 is further preferably comprised of a hard metal material so as not to bend or deform during or after extended use. An outer diameter of the second outer member 52 is preferably substantially similar to an outer diameter of the cavity 23.

The second outer member 52 preferably includes a second extended portion 54 and a second fulcrum portion 53. The second extended portion 54 preferably extends outwardly form the second outer member 52. The second extended portion 54 is further preferably comprised of a rectangular configuration. The second extended portion 54 is preferably positionable within the second recessed portion 26 of the second housing portion 60.

The second outer member 52 also preferably includes a second connecting aperture 59. The second connecting aperture 59 extends through the second extended portion 54. The second connecting aperture 59 further preferably aligns with the second connecting member 27 and is positionable over the second connecting member 27 thus securing the second terminal 50 within the second housing portion 60. The second outer member 52 also preferably includes a second fulcrum portion 53. The second fulcrum portion 53 preferably extends across the second outer member 52. The second fulcrum portion 53 preferably provides an overlapping region for the second inner member 56 to attach to the second outer member 52.

The second inner member 56 is preferably comprised of a circular configuration. An outer diameter of the second inner member 56 is also preferably slightly less than an inner diameter of the second outer member 52. The second inner member 56 is also preferably comprised of a brass material; however other materials may be utilized with the second inner member 56 rather than the preferred material.

The second inner member 56 is preferably spot welded to the second fulcrum portion 53 of the second outer member 52. Utilizing weld substance as a fastener between the first inner member 56 and the first outer member 52 preferably prevents the first inner member 56 from becoming loose upon the first outer member 52 over extended use. A concentric origin of the second inner member 56 is also preferably substantially similar to a concentric origin of the second outer member 52 when attaching the second inner member 56 to the second outer member 52.

The second inner member 56 also preferably includes a second contact 57. The second contact 57 preferably extends downward from an outer edge of the second inner member 56. The second inner member 56 is also preferably attached to the second outer member 52 in a manner, wherein an electrical current is able to flow between the second contact 57 and the second extended portion 54 of the second outer member 52.

The second inner member 56 also preferably includes a pivot slot 55 positioned on an inside edge of the second fulcrum portion 53 of the second outer member 52 as shown in FIG. 3. The pivot slot 55 preferably allows the second inner member 56 to pivot about the second outer member 52.

The second contact 57 is preferably positioned so that when the second inner member 56 pivots the second contact 57 is able to be positioned against the first contact 37 of the first inner member 36. When the first contact 37 and the second contact 57 are positioned against one another a circuit is preferably completed thus allowing an electrical current to flow from the first extended portion 34 of the first terminal 30 to the second extended portion 54 of the second terminal 50 or vice versa.

The ultra low pressure switch system 10 also preferably includes a plurality of seal members 42, at least one spacer member 40 and at least one diaphragm member 44. The seal members 42 are preferably comprised of an O-ring configuration. The seal members 42 are further preferably comprised of a rubber material so as to provide a fluid seal within the ultra low pressure switch system 10. An outer diameter of the seal member 42 is preferably comprised of a substantially similar size and configuration as the outer diameter of the first outer member 32 and the second outer member 52.

Figure 6:
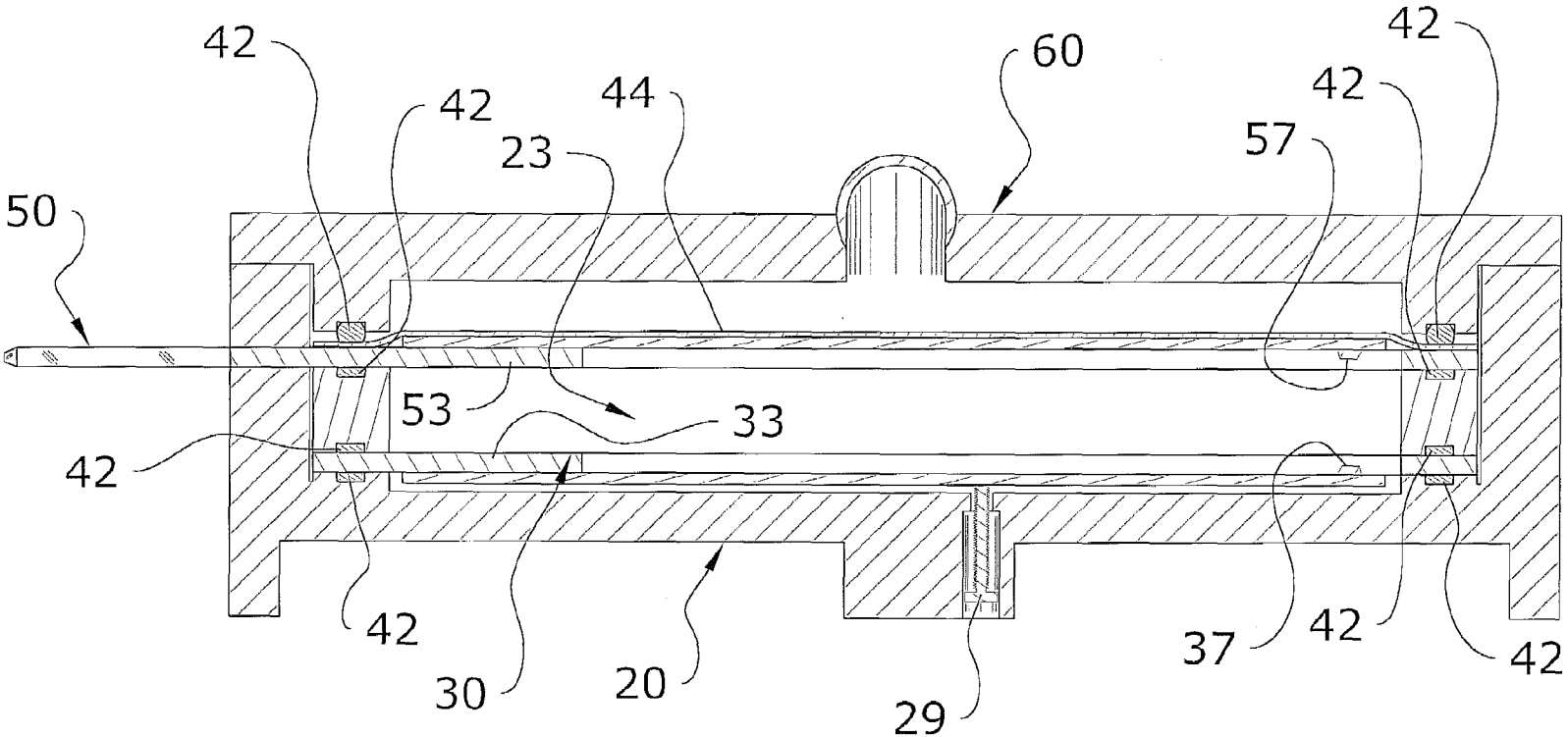
FIG. 6 is a cross-sectional view taken along line 6-6 of FIG. 4.
Figure 7:
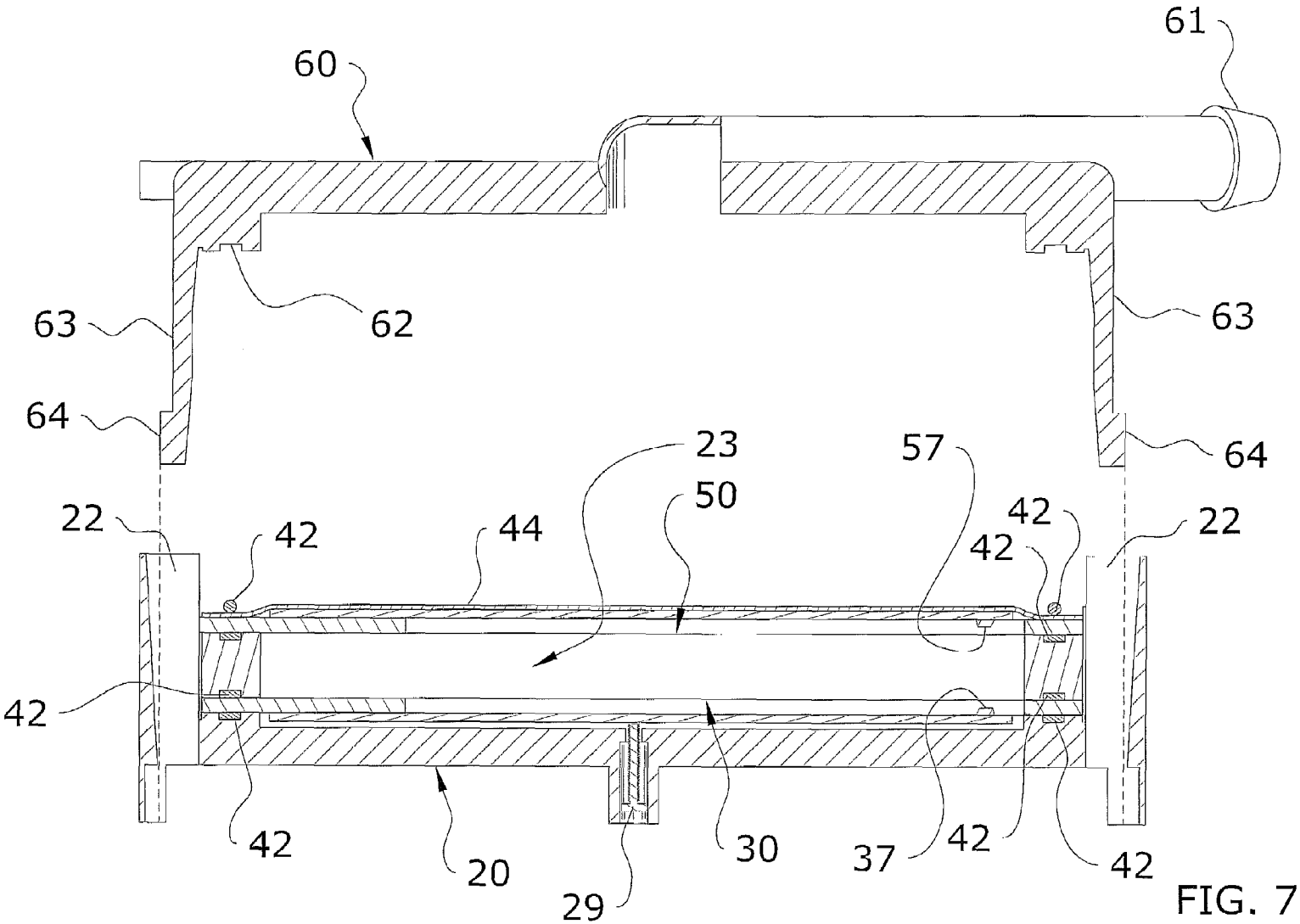
FIG. 7 is a cross sectional view with the upper casing removed from the lower casing.
Figure 8:
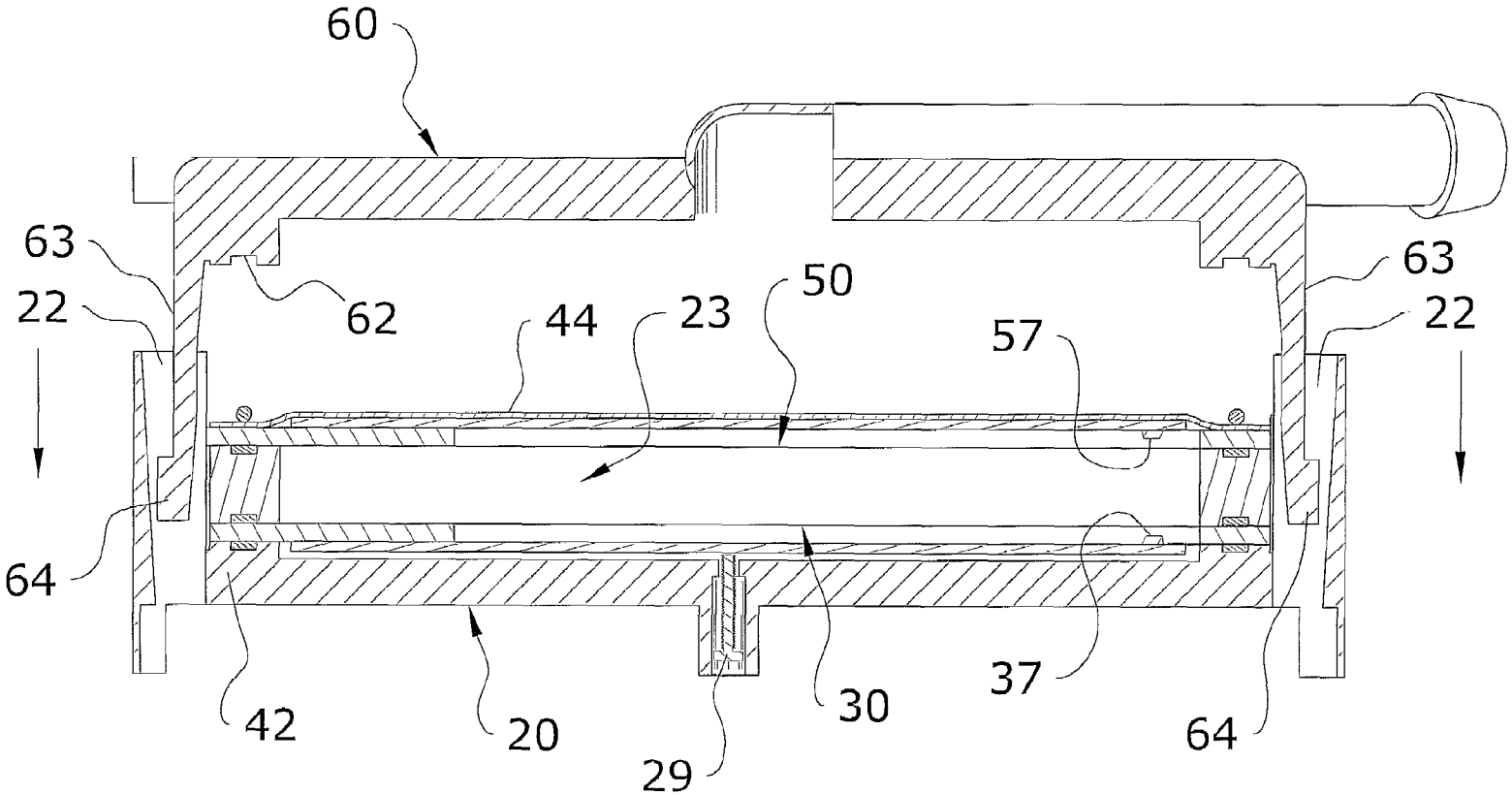
FIG. 8 is a cross sectional view with the upper casing partially attached to the lower casing.

The seal members 42 are preferably spaced at various positions within the ultra low pressure switch system 10 where a fluid seal is desired. The seal members 42 preferably prevent the first pressure and/or the second pressure from escaping the cavity 23 of the housing 20, 60 through the outer wall. The seal members 42 are also preferably able to expand and contract with the housing 20, 60 to consistently provide a fluid seal within the ultra low pressure switch system 10 for multiple environmental conditions. The seal members 42 also preferably fit within a channel 62 of the first housing portion 20, second housing portion 60 and upper and lower ends of the spacer member 40 as illustrated in FIGS. 6 through 8. The channels 62 are also preferably formed to receive the seal members 42 and prevent the seal members 42 from moving from side to side while positioned within the channels 62.

The spacer member 40 is preferably positioned between the first outer member 32 and the second outer member 52 to prevent and keep a consistent distance between the first outer member 32 and the second outer member 52. The spacer member 40 preferably moves up and down with the terminals 30, 50 and expansion/contraction of the housing 20, 60. The spacer members 40 are preferably comprised of an O-ring configuration. The spacer member 40 is further preferably comprised of a thermoplastic or ceramic material; however it is appreciated that the spacer member 40 may be comprised of various materials rather than the preferred embodiment.

It is appreciated that the number of spacer members 40 utilized depends on the size and configuration of the ultra low pressure switch system 10. An outer diameter and an inner diameter of the spacer member 40 are preferably comprised of a substantially similar size and configuration as the outer diameter and the inner diameter of the first outer member 32 and the second outer member 52. It is further appreciated that the spacer member 40 may be weldably attached between the first terminal 30 and the second terminal 50.

The diaphragm member 44 is preferably comprised of a circular configuration. The diaphragm member 44 is also preferably comprised of a material to prevent the passage of the fluid throughout the ultra low pressure switch system 10 from the first port 21 or the second port 61. The diaphragm member 44 preferably forms a first cavity portion and a second cavity portion within the cavity 23 of the housing 20, 60, wherein the first cavity portion is fluidly sealed from the second cavity portion. An outer diameter of the diaphragm member 44 is preferably comprised of a substantially similar size and configuration as the outer diameter of the second outer member 52. The diaphragm member 44 is preferably attached to an upper end of the second outer member 52 and provides a barrier to prevent the second inner member 56 from pivoting upward.

E. Second Housing Portion

Figure 4:
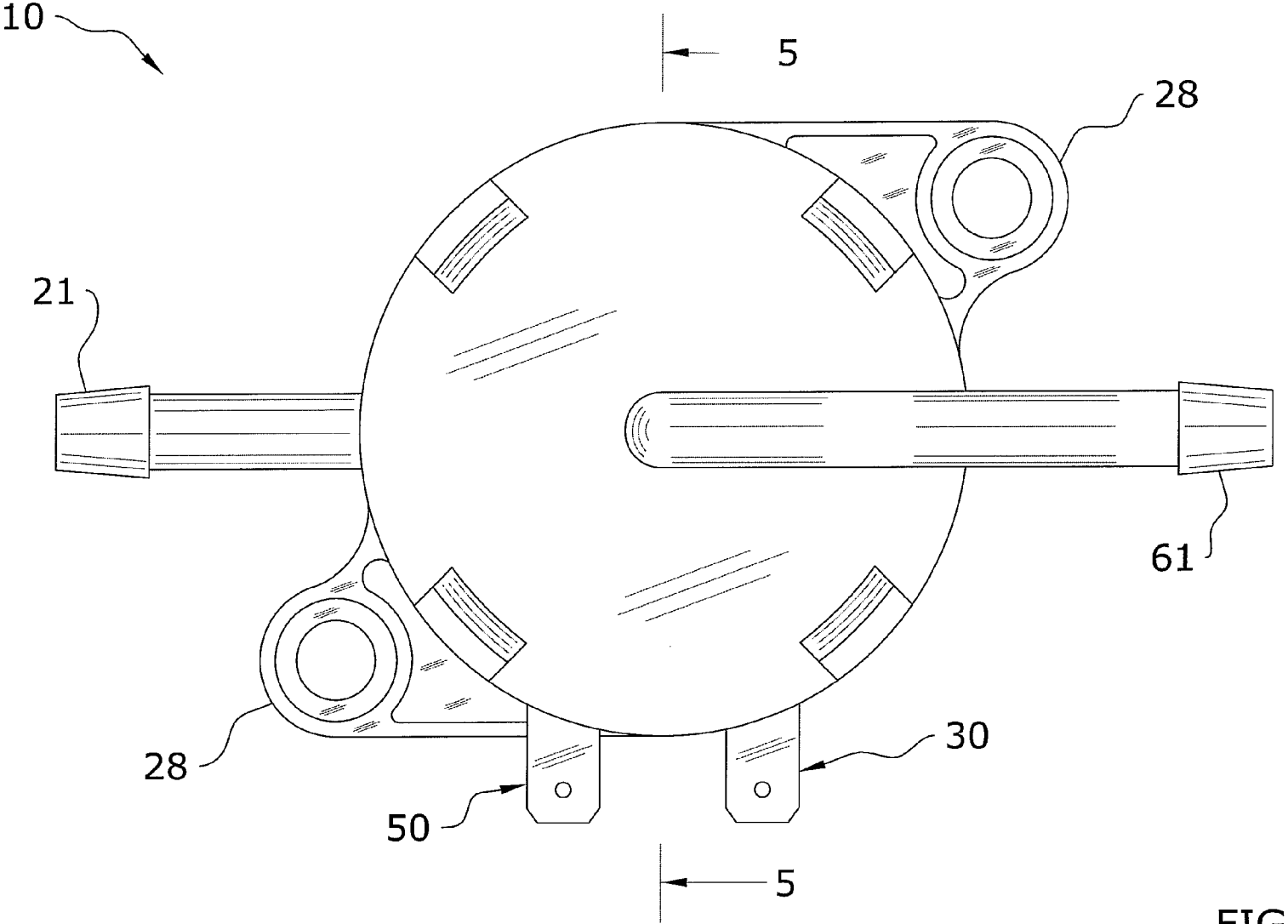
FIG. 4 is a top view of the present invention.

The second housing portion 60 is preferably comprised of a substantially circular configuration as illustrated in FIGS. 2 through 4; however it is appreciated that the second housing portion 60 may be comprised of various configurations rather than the preferred embodiment, such as but not limited to elliptical or rectangular. The second housing portion 60 is preferably comprised of a material to withstand variant temperatures and pressures. The second housing portion 60 is also preferably able to expand and contract accordingly with variant environment conditions. The material of the second housing portion 60 is further preferably comprised of plastic; however other suitable materials may be utilized with the second housing portion 60 rather than the preferred material.

The second housing portion 60 includes a second port 61, wherein the second port 61 preferably receives a second pressure. The second port 61 is preferably comprised of a tubular configuration. The second port 61 also preferably extends horizontally outward from the second housing portion 60 at an opposing side as the first port 21 as illustrated in FIGS. 2 through 5. The second port 61 is also preferably fluidly connected to an inner portion of the second port 61. The second pressure of the second port 61 is preferably comprised of an outwardly blowing pressure.

The second housing portion 60 also preferably includes a plurality of attachment members 63. The plurality of attachment members 63 preferably vertically extend from the second housing portion 60. The plurality of attachment members 63 are also preferably radially positioned substantially near an outer edge of the second housing portion 60 as shown in FIGS. 3 and 5. The attachment members 63 are further preferably positioned to align with the slots 22 of the first housing portion 20.

Figure 9:
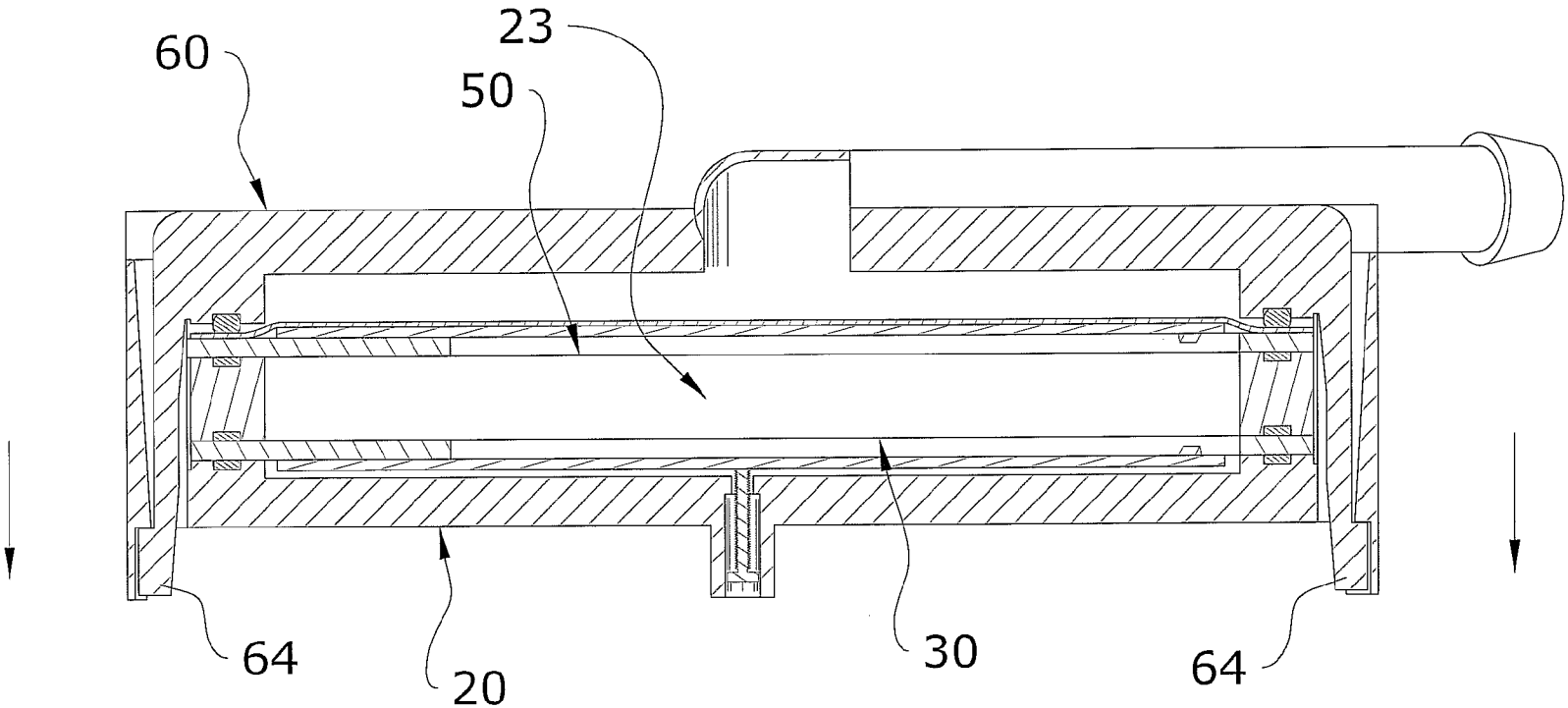
FIG. 9 is a cross sectional view with the upper casing attached to the lower casing.

Each of the attachment members 63 preferably includes a locking portion 64. The locking portion 64 preferably extends out horizontally from the attachment members 63 as shown in FIGS. 7 through 9. The locking portion 64 is also preferably positioned at a lower end of the attachment members 63. The locking portion 64 preferably extends horizontally beyond a lower end of the slots 22 when the attachment members 63 are positioned within the slots 22. The locking portion 64 further preferably prevent the attachment members 63 and second housing portion 60 from being easily removed from the first housing portion 20.

An outer wall of the second housing portion 60 preferably includes a first connecting portion 66 and a second connecting portion 68. The first connecting portion 66 and the second connecting portion 68 preferably both extend vertically downward from the outer wall of the second housing portion 60 as illustrated in FIGS. 2 and 3. The first connecting portion 66 is preferably positioned at a substantially lower vertical height than the second connecting portion 68.

The first connecting portion 66 and the second connecting portion 68 are also both preferably comprised of a rectangular configuration; however it is appreciated that first connecting portion 66 and the second connecting portion 68 may be comprised of various embodiments rather than the preferred embodiment. The first connecting portion 66 is preferably substantially similar in size and configuration to the first recessed portion 24. The second connecting portion 68 is also preferably substantially similar in size and configuration to the second recessed portion 26.

Extending vertically upward from the first connecting portion 66 is preferably a first receiving aperture 67. A second receiving aperture 69 also preferably extends vertically upward from the second connecting portion 68. The first receiving aperture 67 preferably receives the first connecting member 25 and the second receiving aperture 69 preferably receives the second connecting member 27. When the second housing portion 60 is attached to the first housing portion 20 the first extended portion 34 of the first terminal 30 is preferably sandwiched between the first connecting portion 68 and the first recessed portion 24. The second terminal 50 is also preferably sandwiched between the second connecting portion 69 and the second recessed portion 25 when the second housing portion 60 is attached to the first housing portion 20.

F. Assembly of Invention

In assembly, the first housing portion 20 is first positioned so that the cavity 23 faces upward. A first seal member 42 is then positioned within the channel 62 of the cavity 23. The first terminal 30 is then positioned over the first seal member 42, wherein the first connecting aperture 39 of the first terminal 30 is positioned over the first connecting member 25 of the first housing portion 20. A second seal member 42, subsequent spacer member 40 and subsequent third seal member 42 are then positioned over the first terminal 30, wherein the second seal member 42 is positioned within a channel 62 adjacent to the lower end of the spacer member 40 and the third seal member 42 is positioned within the channel 62 adjacent to the upper end of the spacer member 40. It is appreciated that more or less seal members 42 and spacer members 40 may be utilized if desired with the ultra low pressure switch system 10.

The second terminal 50 is then preferably positioned over the third seal member 42, wherein the second connecting aperture 59 of the second terminal 50 is positioned over the second connecting member 27 of the first housing portion 20. The first terminal 30 is fluidly sealed with respect to the second terminal 50 and the first housing portion 20 via the spacer member 40, second seal member 42 and third seal member 42. The diaphragm member 44 is then attached to the upper end of the second terminal 50 and a fourth seal is then positioned over the diaphragm member 44 and within the channel 62 of the second housing portion 60.

The diaphragm member 44 is preferably fluidly sealed with respect to the second housing portion 60 of the housing 20, 60 defining a first cavity portion within the housing 20, 60. The second terminal 50 is preferably fluidly sealed with respect to the diaphragm member 44. A second cavity portion is formed within the housing between the diaphragm member, the first terminal, the second terminal and the first portion of the housing. The second cavity portion is also preferably fluidly sealed from the first cavity portion.

The second housing portion 60 is then attached to the first housing portion 20 via the attachment slots 22 removably attaching within the slots 22 and the connecting portions 66, 68 removably attaching within the recessed portions 24, 26. The first terminal 30, plurality of seal members 42, spacer member 40, second terminal 50 and diaphragm member 56 are all preferably freely floating within the first housing portion 20 and the second housing portion 60 when the ultra low pressure switch system 10 is assembled.

The free floating structure allows the ultra low pressure switch system 10 to expand and contract while maintaining a consistent trip point for the first pressure or the second pressure. What has been described is the preferred method of assemblage as illustrated in FIG. 3. Other methods of assemblage may be utilized with the ultra low pressure switch system 10.

G. In Use

In use, the adjustment member 29 is first adjusted so that the second contact 57 of the second terminal 50 makes contact with the first contact 37 of the first terminal 30 at the desired pressure. Extending the adjustment member 29 upwardly forces the first inner member 36 of the first terminal 30 upward thus reducing the pressure needed to complete the circuit of the first terminal 30 and the second terminal 50. Lowering the adjustment member 29 subsequently lowers the first inner member 36 of the first terminal 30 thus increasing the pressure needed to complete the circuit of the first terminal 30 and the second terminal 50.

A pressure hose may now be attached to the first port 21 or the second port 61. If the pressure hose is comprised of a vacuum hose the pressure hose is preferably removably attached to the first port 21. The first pressure of the first port 21 pulls the second inner member 56 downward to complete the circuit. If the pressure hose is comprised of a forwardly blowing pressure hose the pressure hose is preferably removably attached to the second port 61. The second pressure of the second port 61 pushes the second inner member 56 downward to complete the circuit.

To remove the second housing portion 60 from the first housing portion 20 an inward force is applied to the attachment members 63 forcing the locking portion 64 of the adjustment members 63 to align with the slots 22 of the first housing portion 20. The second housing portion 60 may now be pulled away from the first housing portion 20.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. An ultra low pressure switch, comprising:

a housing comprised of a first portion and a second portion, wherein said first portion and said second portion define a cavity between thereof;

a first port fluidly connected to said housing;

a diaphragm member positioned within said cavity;

a first terminal positioned within said cavity;

a second terminal positioned within said cavity, wherein said second terminal is positioned adjacent to said diaphragm member; and a spacer member positioned within said cavity, wherein said spacer member is positioned between said first terminal and said second terminal to prevent and keep a consistent distance between said first terminal and said second terminal;

wherein a first side of said spacer member is adjacent to said first terminal and a second side of said spacer member is adjacent said second terminal, wherein said second side is opposite of said first side;

wherein said first terminal includes a first outer member and a first inner member, wherein said first outer member includes a first fulcrum portion and wherein said first inner member is weldably attached to said first fulcrum portion.

2. The ultra low pressure switch system of claim 1, including a plurality of seal members positioned within said cavity.

3. The ultra low pressure switch system of claim 2, wherein said plurality of seal members are comprised of an O-ring configuration.

4. The ultra low pressure switch system of claim 2, wherein said first terminal, said second terminal, said diaphragm member, said spacer member and said plurality of seal members form a floating structure within said cavity.

5. The ultra low pressure switch system of claim 1, wherein an outer wall of said first portion includes a first recessed portion, wherein said first terminal is positioned within said first recessed portion.

6. The ultra low pressure switch system of claim 5, wherein said second portion includes a first connecting portion, wherein said first terminal is attached between said first connecting portion and said first recessed portion.

7. The ultra low pressure switch system of claim 1, wherein an outer wall of said first portion includes a first recessed portion, wherein said first terminal is positioned within said first recessed portion and wherein said outer wall of said first portion includes a second recessed portion, wherein said second terminal is positioned within said second recessed portion.

8. The ultra low pressure switch system of claim 7, wherein said second portion includes a first connecting portion and a second connecting portion, wherein said first terminal is attached between said first connecting portion and said first recessed portion and wherein said second terminal is attached between said second connecting portion and said second recessed portion.

9. The ultra low pressure switch system of claim 1, wherein a first outer diameter of said first inner member is less than a first inner diameter of said first outer member.

10. The ultra low pressure switch system of claim 1, wherein said second terminal includes a second outer member and a second inner member, wherein said second outer member includes a second fulcrum portion and wherein said second inner member is weldably attached to said second fulcrum portion.

11. The ultra low pressure switch system of claim 10, wherein a first outer diameter of said first inner member is less than a first inner diameter of said first outer member and wherein a second outer diameter of said second inner member is less than a second inner diameter of said first outer member.

12. The ultra low pressure switch system of claim 1, wherein said second portion includes a plurality of attachment members extending vertically outward from said second portion.

13. The ultra low pressure switch system of claim 12, wherein said first portion includes a plurality of elongated slots extending through said first portion, wherein said plurality of attachment members attach within said plurality of elongated slots.

14. The ultra low pressure switch system of claim 1, wherein said first terminal includes a first extended portion and wherein said second terminal includes a second extended portion, wherein said first extended portion and said second extended portion extend through said housing.

15. The ultra low pressure switch system of claim 1, including a second port fluidly connected to said housing on an opposing side of said housing as said first port.

16. An ultra low pressure switch system, comprising:

a housing comprised of a first portion and a second portion, wherein said first portion and said second portion define a cavity between thereof;

a first port fluidly connected to said housing;

a diaphragm member positioned within said cavity;

a said first terminal is positioned within said cavity;

a second terminal positioned within said cavity, wherein said second terminal is positioned adjacent to said diaphragm member;

a spacer member positioned within said cavity and between said first terminal and said second terminal;

a plurality of seal members positioned within said cavity, wherein said plurality of seal members are comprised of an O-ring configuration;

wherein said first terminal, said second terminal, said diaphragm member, said spacer member and said plurality of seal members form a floating structure within said cavity;

wherein an outer wall of said first portion includes a first recessed portion, wherein said first terminal is positioned within said first recessed portion and wherein said outer wall of said first portion includes a second recessed portion, wherein said second terminal is positioned within said second recessed portion;

wherein said second portion includes a first connecting portion and a second connecting portion, wherein said first terminal is attached between said first connecting portion and said first recessed portion and wherein said second terminal is attached between said second connecting portion and said second recessed portion;

wherein said first terminal includes a first outer member and a first inner member, wherein said first outer member includes a first fulcrum portion and wherein said first inner member is weldably attached to said first fulcrum portion and wherein said second terminal includes a second outer member and a second inner member, wherein said second outer member includes a second fulcrum portion and wherein said second inner member is weldably attached to said second fulcrum portion;

wherein a first outer diameter of said first inner member is less than a first inner diameter of said first outer member and wherein a second outer diameter of said second inner member is less than a second inner diameter of said first outer member;

wherein said second portion includes a plurality of attachment members extending vertically outward from said second portion;

wherein said first portion includes a plurality of elongated slots extending through said first portion, wherein said plurality of attachment members attach within said plurality of elongated slots;

wherein said first terminal includes a first extended portion and wherein said second terminal includes a second extended portion, wherein said first extended portion and said second extended portion extend through said housing; and a second port fluidly connected to said housing on an opposing side of said housing as said first port.

17. An ultra low pressure switch, comprising:

a housing comprised of a first portion and a second portion, wherein said first portion and said second portion define a cavity between thereof;

a first port fluidly connected to said housing;

a diaphragm member positioned within said cavity;

a first terminal positioned within said cavity, wherein said first terminal includes a first outer member and a first inner member, wherein said first outer member includes a first fulcrum portion and wherein said first inner member is weldably attached to said first fulcrum portion;

a second terminal positioned within said cavity, wherein said second terminal is positioned adjacent to said diaphragm member; and a spacer member positioned within said cavity and between said first terminal and said second terminal.

18. The ultra low pressure switch system of claim 17, wherein a first outer diameter of said first inner member is less than a first inner diameter of said first outer member.

19. The ultra low pressure switch system of claim 17, wherein said second terminal includes a second outer member and a second inner member, wherein said second outer member includes a second fulcrum portion and wherein said second inner member is weldably attached to said second fulcrum portion.

* * * * *